United States Patent [19]

Szabo, deceased et al.

[11] Patent Number: 4,976,426

[45] Date of Patent: Dec. 11, 1990

[54] REHABILITATION EXERCISE DEVICE

[75] Inventors: Louis Szabo, deceased, late of Penticton, Edith Szabo, executrix; Gavril Morariu, Port Moody; Eric W. Banister, West Vancouver, all of Canada

[73] Assignee: Garden Reach Developments Ltd., Penticton, Canada

[21] Appl. No.: 404,297

[22] Filed: Sep. 6, 1989

[51] Int. Cl.[5] ..... A63B 21/008

[52] U.S. Cl. ..... 272/130; 272/129; 272/134; 272/DIG. 4; 128/25 R

[58] Field of Search ..... 272/69, 70, 72, 73, 272/125, 129, 130, 132, 134; 128/25 R, 25 B

[56] References Cited

U.S. PATENT DOCUMENTS

| | | | |
|---|---|---|---|
| 2,183,265 | 12/1939 | Maloney | 128/25 R |
| 3,017,180 | 1/1962 | Aronsohn | 272/134 X |
| 3,374,675 | 3/1968 | Keropian | 128/25 R |
| 3,455,295 | 7/1969 | Kellogg | 128/25 R |
| 3,744,480 | 7/1973 | Gause et al. | 128/73 X |
| 3,848,870 | 11/1974 | Craig | 272/73 X |
| 3,964,742 | 6/1976 | Carnielli | 272/73 |
| 3,991,749 | 11/1976 | Zent | 128/25 R |
| 4,358,105 | 11/1982 | Sweeney, Jr. | 272/73 |
| 4,572,501 | 2/1986 | Durham et al. | 272/25 R X |
| 4,601,468 | 7/1986 | Bono et al. | 272/130 |
| 4,684,126 | 8/1987 | Daleboot et al. | 272/132 X |
| 4,691,694 | 9/1987 | Boyd et al. | 128/25 R |
| 4,711,450 | 12/1987 | McArthur | 272/130 X |
| 4,776,583 | 10/1988 | Jennings | 272/73 |
| 4,848,737 | 7/1989 | Ehrenfield | 272/70 |
| 4,865,315 | 9/1989 | Paterson et al. | 272/130 |

FOREIGN PATENT DOCUMENTS

| | | | |
|---|---|---|---|
| 8605404 | 9/1986 | World Int. Prop. O. | 272/130 |

*Primary Examiner*—Robert Bahr

*Attorney, Agent, or Firm*—Townsend and Townsend

[57] ABSTRACT

An exercise device offers different levels of exercise to an individual and can be arranged as an exercise device for bedridden patients and those in different stages of rehabilitation. The device comprises an exercise head having at least one pair of crank arms for rotation of limbs of the individual about an axial shaft. A hydraulic motor is linked to the axial shaft to rotate the crank arms with hydraulic power source for the motor. Rotational speed of the axial shaft is set by a speed adjustment arrangement associated with the hydraulic motor. A force adjustment system adjusts the force applied to the limbs through the crank arms to rotate the axial shaft beyond a set rotational speed. Variation in the speed of the axial shaft is sensed by a speed sensing arrangement. A system for sensing force to sense variation in force applied to the crank arms by the limbs of the individual.

11 Claims, 7 Drawing Sheets

REHABILITATION EXERCISE DEVICE

The present invention relates to an exercise device for offering different levels of exercise to an individual. More specifically the present invention provides an exercise device which may be used in the passive or active mode for exercising the limbs of an individual either in an upright position, a sitting position or in a prone position. The device provides for exercising arms and legs either separately or together.

BACKGROUND OF THE INVENTION

Increasingly regimented training programs are being implemented in bedridden patients, first in the early course of convalescence and second during formal rehabilitation. Thirdly, such activity continued into the patient's everyday life, post rehabilitation, at an enhanced level of activity usually proves beneficial.

While the methods and results of the second and third stages of the above course of treatment are well documented, the earlier stage which occurs from the first moment of bed rest or complete inactivation, is less well studied or catered for.

As the prognosis for those with motor impairment improves due to progress and research into neural transplantation, functional electrical stimulation, and stimulation of nueral regeneration, it becomes increasingly important to institute exercise procedures as early as possible in their rehabilitation. In bedridden patients this should combat functional degeneration. The rehabilitation device of the present application is able to offer any level of exercise in awake or unconscious patients, compatible with the integrity of their functional systems, as medically prescribed.

Devices for exercising or moving the legs and/or arms of a person in a supine or partially raised position, such as bedridden patients, are known in the prior art. Examples of such devices include those described and illustrated in U.S. Pats. Nos. 2,062,300 to Erickson, 3,455,295 to Kellogg, 3,596,654 to Tamura, 3,661,149 to Ferries, 3,848,870 to Craig, 3,895,623 to Mahlandt et al, 4,282,865 to Pogue, and also in Canadian Patent Nos. 340,347 to Davison and 1,180,242 to Ventura. Other exercising devices which are not necessarily restricted to bedridden patients includes U.S. 3,744,480 to Gause, U.S. 3,964,742 to Carnielli, U.S. 3,991,749 to Zent and U.S. 4,358,105 to Sweeney Jr. All of these devices illustrate the state of the art for exercise devices useful both for bedridden patients and those more active. Many of these devices utilize mechanical drive means which do not have the ability to adjust in the same way as the present device utilizing fluid principles. Thus these prior art devices do not have the versatility presently needed to rehabilitate bedridden patients today.

It is an aim of the present invention to provide a rehabilitation exercise device utilizing hydraulics to provide versatility to take into account different patient requirements in both an active and passive mode. It is a further aim of the present invention to control force requirements with precision with high sensitivity to subject's response to initiated movement and to obtain negative feedback from spend and force of movement whether the machine is operated in the passive or active mode.

It is a further aim to provide a machine that is sensitive to any initiated movement that is suddenly resisted by the patient due to muscular spasms and the like. In a preferred embodiment there is provided a connection to a heart beat monitoring device, such that a change in the rate of heart beat would immediately reset the patient and machine to a neutral condition.

The present invention provides a computer controlled rotary hydraulic device suitable for producing both passive and active movements and to take into account muscle contractions that may occur while attempting to forcibly stretch the muscles. In a preferred embodiment a multi model rehabilitation exercise device may be provided with one exercise head to be used for the legs and a second exercise head for the arms.

The present invention provides an exercise device for offering different levels of exercise for an individual, the device comprising an exercise head having at least one pair of crank arms for rotation of limbs of the individual about an axial shaft, a hydraulic motor linked to the axial shaft to rotate the crank arms with hydraulic power source for the motor, speed adjustment means in association with the hydraulic motor to set rotational speed of the axial shaft, force adjustment means to adjust force applied to the limbs through the crank arms, to rotate the axial shaft beyond a set rotational speed, speed sensing means to sense variation in the speed of the axial shaft, and force sensing means to sense variation in force applied to the crank arms by the limbs of the individual.

BRIEF DESCRIPTION OF THE DRAWINGS

In drawings which illustrate embodiments of the invention.

DETAILED DESCRIPTION OF THE INVENTION

Figure 1:
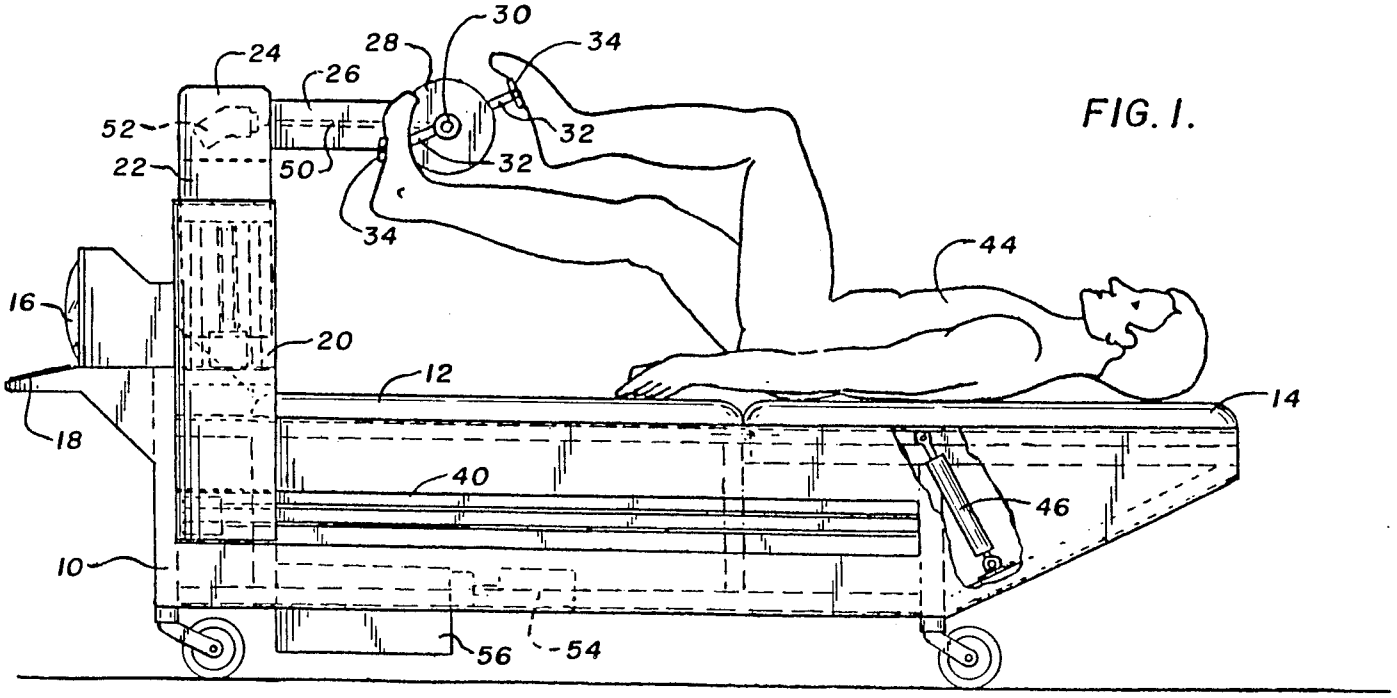
FIG. 1 is a side view of an exercise device in accordance with one embodiment of the invention for a patient in the supine position and setup for movement of a patient's legs.
Figure 2:
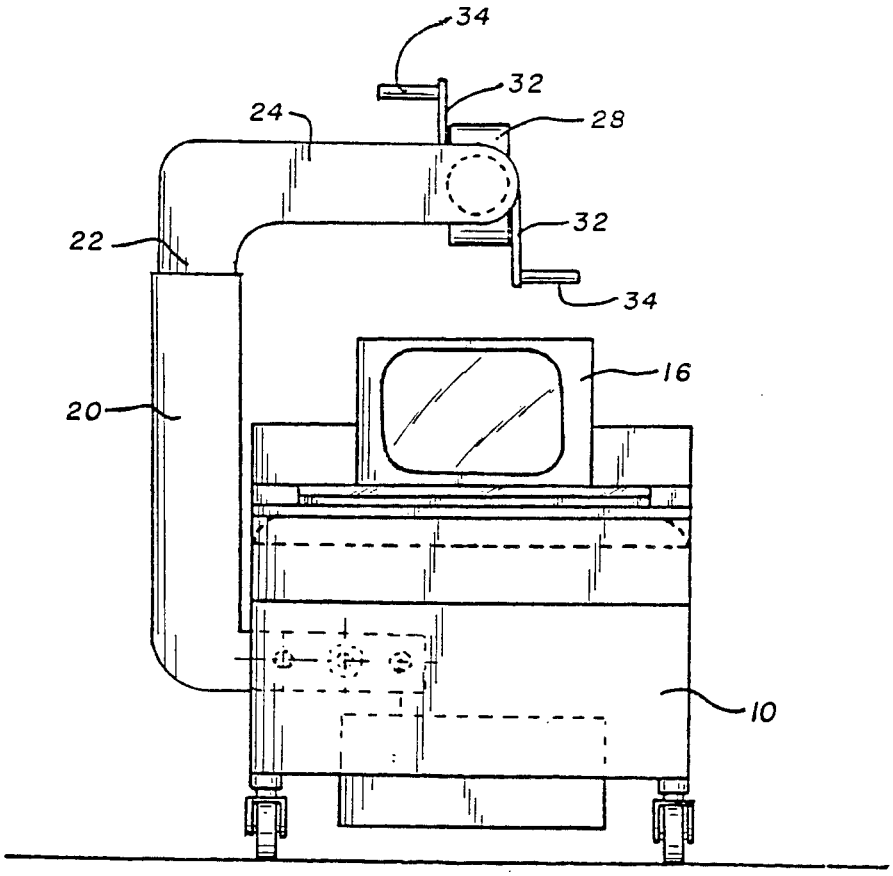
FIG. 2 is an end view of the exercise device shown in FIG. 1.

Referring now to the drawings, FIG. 1 illustrates a support table 10 having a horizontal top surface 12 which extends to a back support 14 shown in the horizontal position. At the end of the table, away from the back support 14 is a CRT 16 and keyboard 18 for controlling the exercise device. A vertical support column pedestal 20 extends upwards on one side of the table 10 as may be seen more clearly in FIG. 2. A top portion 22 of the column pedestal 20 moves vertically up and down and has an arm 24 which extends to the approximate centre position of the work table 10 and connects to a tubular support 26 extending horizontally and in line with the table 10. An exercise head 28 comprises an axial shaft 30 connected on each side of the head 28 to two crank arms 32 which in turn have foot pedals 34 at the end similar to those provided on a bicycle. The foot pedals 34 may have straps (not shown) to hold the feet in continuous contact with the pedals if a patient is unconscious.

Figure 3:
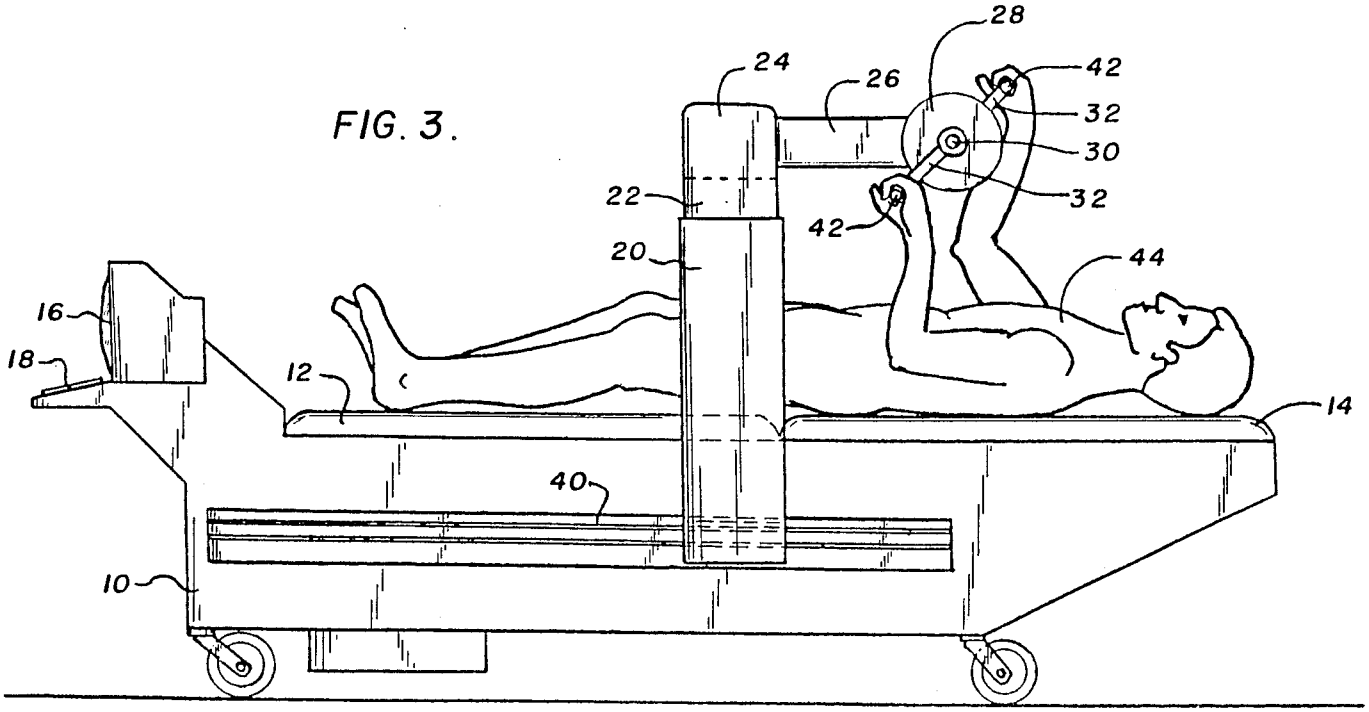
FIG. 3 is a side view of the exercise device shown in FIG. 1 set up for movement of a patient's arms.

The column pedestal 20 is mounted in a side rail 40 and is thus able to move lengthwise along the side of the table so that the exercise head can be positioned either for foot operation or for arm opeation as shown in FIG. 3. In the case of arm or hand operation the foot pedals 34 are replaced by hand grips 42, and straps may be provided to maintain continuous contact between a patient's hands and the grips 42. Thus an individual 44 may lie on the table and the exercise head is positioned to suit the individual by sliding the column pedestal 20 backwards and forwards on the side rail 40, and moving the top portion 22 in the column pedestal 20 for height adjustment. As shown in FIG. 1 the back support 14 has a hydraulic cylinder 46 for adjusting the slope. Thus the table can be arranged to suit the particular medical requirements and size of an individual.

Figure 4:
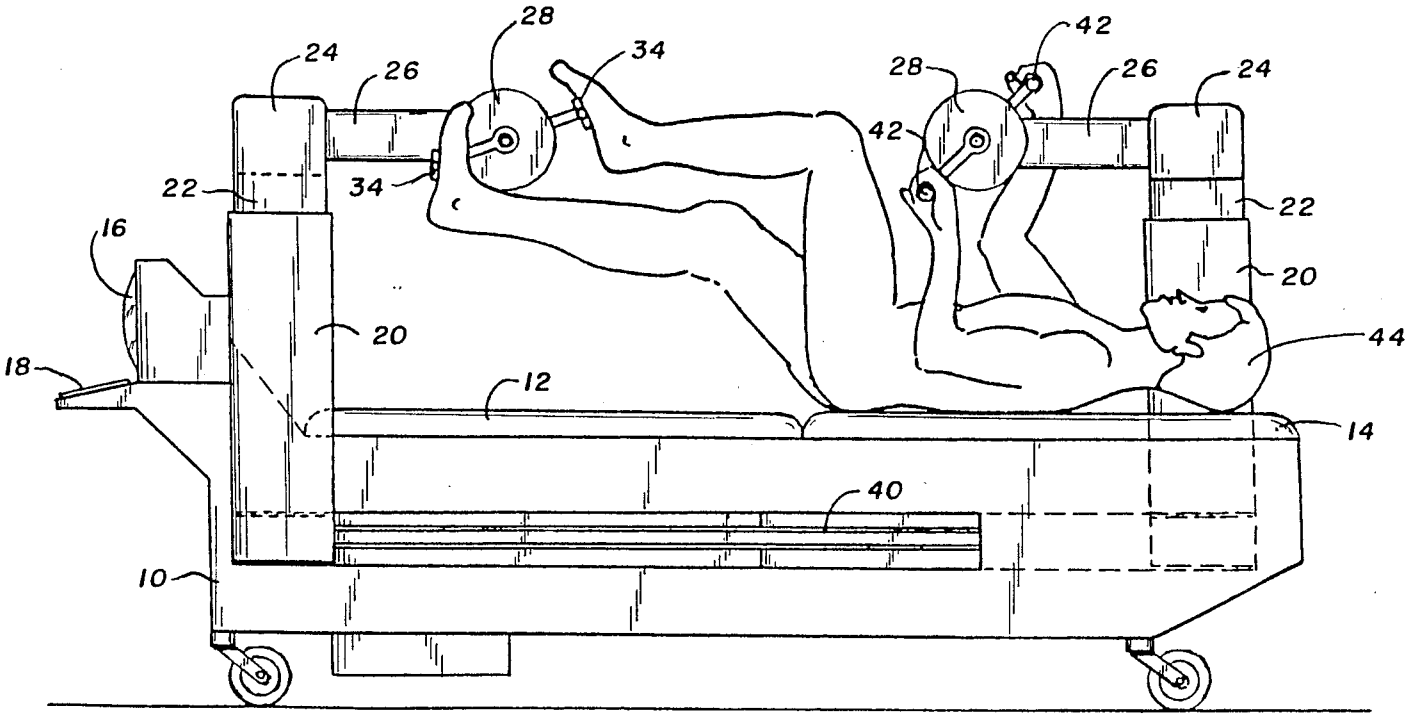
FIG. 4 is a side view of the exercises device similar to that shown in FIG. 1 with two exercises heads, a first head set up for movement of a patient's legs and the second head set up for movement of a patient's arms.

FIG. 4 illustrates a second exercise head 28 connected to a second vertical support column pedestal 20 which in turn fits into a second side rail 40 on the other side of the table 10 from the first side rail. The two exercises heads 28 are arranged one for operation by the legs and one for operation by the arms of an individual.

Each exercise head 28 has an axial shaft 30 which either rotates or is rotated by the foot pedals 34 or hand grips 42 and in turn either drives or is driven by a shaft 50 operated by a combined hydraulic motor and pump combination unit 52 as shown. A hydraulic pump 54 is located in the bottom of the table 10 with a hydraulic reservoir 56. The arrangement of hydraulic and electrical controls will be described hereafter.

Figure 5:
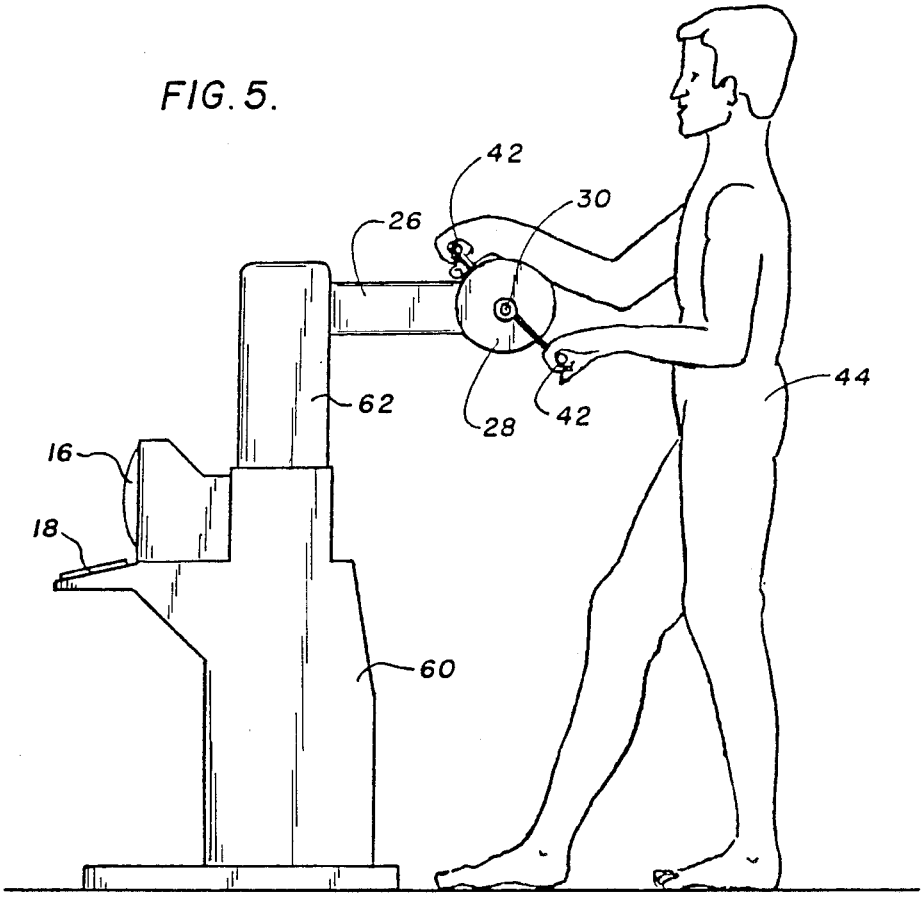
FIG. 5 is a side view of an exercise device according to another embodiment of the present invention set up for movement of a patient's arms when the patient is in the standing position.
Figure 6:
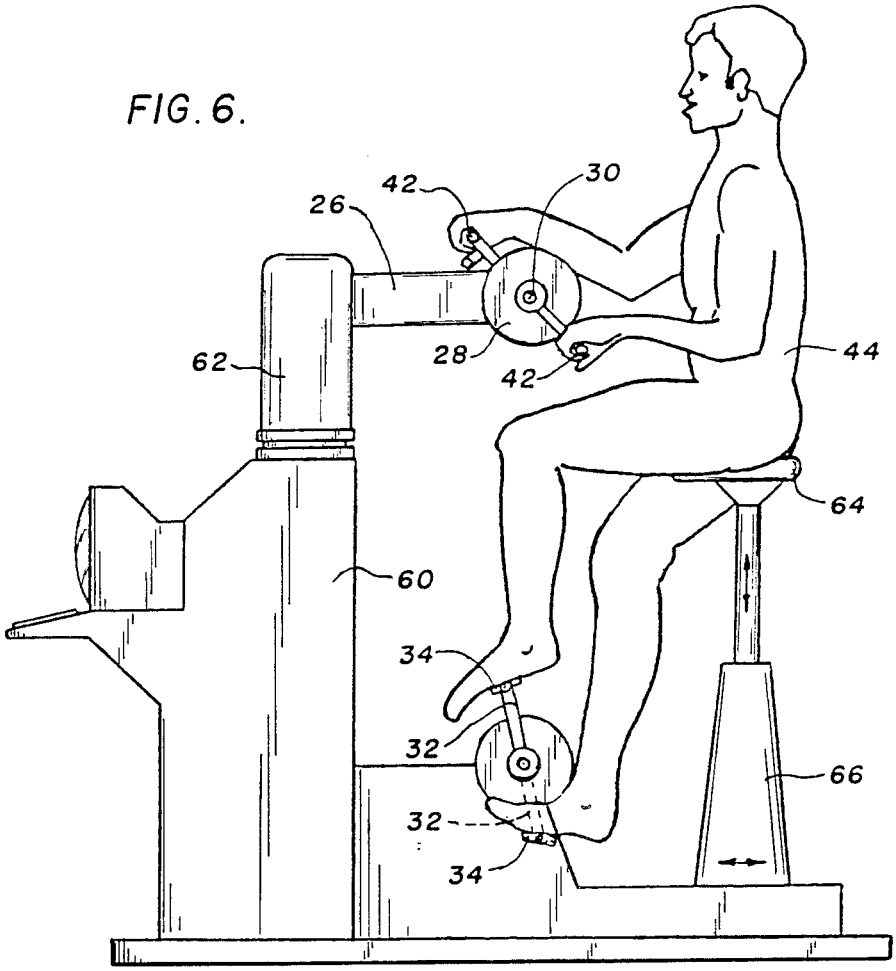
FIG. 6 is a side view of an exercise device according to another embodiment of the present invention having two exercise heads and a stool arrangement set up for movement of a patient's arms and legs.

Another embodiment of an exercise device is shown in FIG. 5. A stand 60 which rests on the ground, has a CRT 16 and keyboard 18, as in the exercise device shown in FIGS. 1 to 4, but has no support table. A top portion 62 similar to the top portion 22 shown in FIG. 1 moves vertically up and down within the stand 60. There is no cross arm but an extender piece 26 projects outward from the top of the top portion 62 to an exercise head 28. Hand grips 42 are provided at the ends of the two crank arms 32 and an individual 44 is shown standing with hands on the hand grips 42. The height of the exerciser head 28 can be adjusted by moving the top portion 62 within the stand 60. FIG. 6 illustrates another embodiment wherein a stool 64 with height adjustment base 66 provides a seat for an individual 44 to sit on. As well as a top exercising head 28 similar to that shown in FIG. 5 a bottom exercising head 28 is also provided with foot pedals 34. The height of the stool 64 can be adjusted to suit the height of an individual 44, and the position of the top exerciser head 28 can be adjusted by moving the top portion 62 up and down within the stand 60. The extender piece 26 can in some embodiments be adjustable to move the top exerciser head 30 away from the stand 60 to suit different individuals. In the embodiment shown in FIG. 6, the height adjustment base 66 can move backwards and forward for further adjustment to suit different sized individuals.

Figure 7:
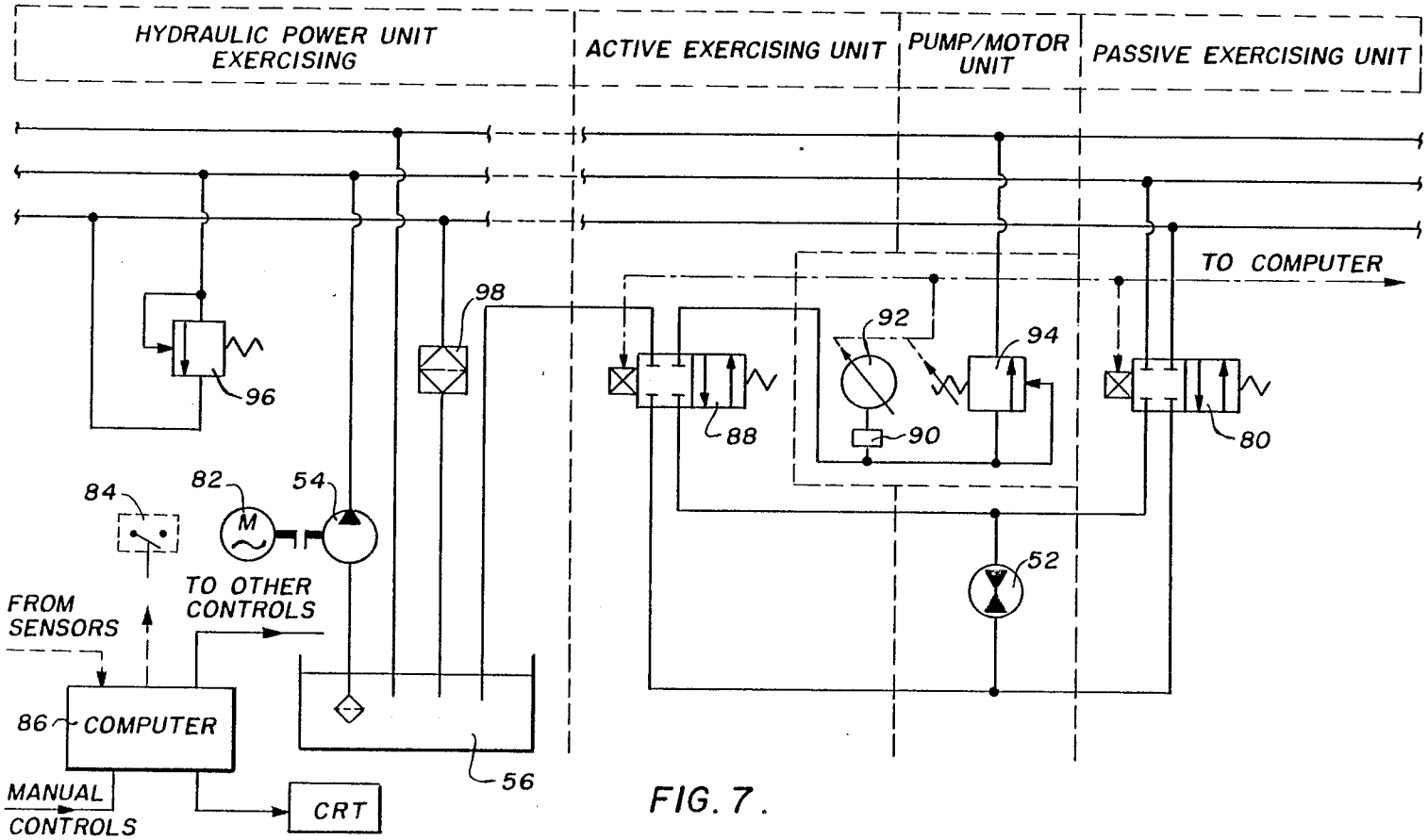
FIG. 7 is a schematic diagram showing the hydraulics and electrics according to one embodiment of an exercise device.

The operation of the exercise device can be understood by referring to the schematic diagram of FIG. 7 wherein rotation of the axial shaft 30 of the exercise head 38 is linked directly to the combination hydraulic pump and motor 52. This is a fixed displacement pump motor which in some circumstances acts as a pump and in other circumstances acts as a motor dependent upon the medical treatment required for the patient. When the operation of the exercise device is in the passive mode, a first proportional hydraulic valve 80 is opened by a solenoid. In the passive mode the hydraulic pump motor 52 is driven by the hydraulic pump 54 and an electric motor 82 driving the hydraulic pump 54 has an adjustable speed arrangement 84 which is controlled by a computer 86. Thus in the passive exercising mode the hydraulic pump 54 rotates the pump motor unit 52 which rotates the crank arms 32 to provide movement for an individual's limbs. The speed of this movement is controlled from the keyboard 18 and provision is made for each patient to have a specific program both for time and speed.

The unit can be placed in the active exercising mode in which case the valve 80 is closed and a second proportional hydraulic valve 88 is opened. In this mode the pump motor unit 52 is driven by the muscular activity of an individual. A pressure transducer 90 measures pressure and a digital indicator 92 indicates the pressure that is achieved by the individual in the active mode or the hydraulic pump 54 in the passive mode. A pressure differential switch 94 allows variation in pressure to be set and if there is a sudden pressure difference the pressure transducer 90 senses the change, shuts off the hydraulic pump 54 to allow the machine to return to a neutral position. Thus the pressure of the hydraulic fluid in the system is constantly measured and the force applied to the crank arms 32 is determined.

A revolution counter (not shown) is provided to determine the exact speed of the axial shaft 30 in the exercise head 28 and a differential circuit in the computer indicates a change in speed either in acceleration or deceleration. The signal is used to indicate a change in an individual's application either in the passive or active mode. A sudden change of speed is monitored and can be set to place the machine in the neutral position.

As shown in FIG. 7 a pressure relief valve 96 is provided for the hydraulic system and a high pressure oil filter 98 is connected into the hydraulic system to ensure that the hydraulic oil is filtered after being pumped through the pump motor.

In the case where two exercise heads 28 are illustrated, two separate circuit controls are provided one for each head so that one exercise head may be put into the passive mode while the other is in the active mode or alternatively different settings of either active or passive mode may be set for the two heads 28. For the embodiment shown in FIGS. 1 to 4 the hydraulic pump 54 may be used to raise the top portion 22 in the column pedestal 20 or the stand 60 to set the elevation of the exercise head 28 and, in the case of the unit shown in FIGS. 1 to 4, move the column pedestal 20 in the side rail 40. Furthermore the same hydraulic pump 54 may be used to raise the cylinder 46 for the back support 14. Alternatively a separate hydraulic pump may be provided for these functions.

Various changes may be made to the embodiment shown herein without departing from the scope of the present invention which is limited only by the following claims.

The embodiments of the invention in which an exclusive property or privilege is claimed are defined as follows:

1. An exercise device for offering different levels of exercise for an individual, the device comprising:
   an exercise head having at least one pair of crank arms for rotation of limbs of the individual about an axial shaft,
   a hydraulic motor linked to the axial shaft to rotate the crank arms with hydraulic power source for the motor,
   speed adjustment means in association with the hydraulic motor to set rotational speed of the axial shaft,
   force adjustment means to adjust force applied to the limbs through the crank arms, to rotate the axial shaft beyond a set rotational speed,
   speed sensing means to sense variation in the speed of the axial shaft,
   force sensing means to sense variation in force applied to the crank arms by the limbs of the individual,
   an elongate support table having a support arm extending from a column positioned at one side of the table to support the exercise head, the column slidably connected to the side of the support table to move backwards and forwards along the length of the table, and
   a hydraulic means for positioning the support arm and adjusting the height of the exercise head above the table.

2. The exercise device according to claim 1 having control means to select a passive exercising mode wherein the hydraulic motor is rotated by a separate power driven hydraulic pump, or an active exercising mode wherein the hydraulic motor is rotated by the limbs of an individual.

3. The exercise device according to claim 1 wherein two pairs of crank arms on separate axial shafts are provided one pair of crank arms for rotation by the arms of the individual and the second pair of crank arms for rotation by the legs of the individual.

4. The exercise device according to claim 3 wherein the separate axial shafts of the two exercises heads have different speed and force adjustment means and separate speed and force sensing means.

5. The exercise device according the claim 1 including a connection means to monitor heart beat rate and reactivate the exercise device in case of change in heart beat.

6. The exercise device according to claim 1 wherein the crank arms on the axial have pedals for feet.

7. The exercise device according to claim 1 wherein the crank arms on the axial shaft have hand grips for hands.

8. The exercise device according to claim 1 wherein the exercise head is supported from a stand having a vertical height adjustment and including hand grips on the end of the crank arms for rotation by the hands of an individual.

9. The exercise device according to claim 8 including a variable height stool arrangement and a second exercise head having foot pedals on the ends of the crank arms positioned for operation by the feet of an individal sitting on the stool.

10. The exercise device according to claim 1 including a programmable computer to set level of exercise for different individuals.

11. An exercise device for offering different levels of exercise for an individual, the device comprising:
   an exercise head having at least one pair of crank arms for rotation of limbs of the individual about an axial shaft,
   a hydraulic motor linked to the axial shaft to rotate the crank arms with hydraulic power source for the motor,
   speed adjustment means in association with the hydraulic motor to set rotational speed of the axial shaft,
   force adjustment means to adjust force applied to the limbs through the crank arms, to rotate the axial shaft beyond a set rotational speed,
   speed sensing means to sense variation in the speed of the axial shaft,
   force sensing means to sense variation in force applied to the crank arms by the limbs of the individual,
   an elongate support table having a support arm extending from a column positioned at one side of the table to support the exercise head, the column slideably connected to the side of the support table to move backwards and forwards along the length of the table,
   hydraulic means for raising and lowering the exercise head above the table operated from the same hydraulic power source as the hydraulic motor linked to the axial shaft to rotate the crank arms of the exercise head.

* * * * *

UNITED STATES PATENT AND TRADEMARK OFFICE

CERTIFICATE OF CORRECTION

PATENT NO. : 4,976,426

DATED : December 11, 1990

INVENTOR(S) : Louis Szabo, Gavril Morariu, Eric W. Banister

It is certified that error appears in the above-identified patent and that said Letters Patent is hereby corrected as shown below:

In column 1, line 63, please delete "spend" and insert therefor --speed--.

Signed and Sealed this

Nineteenth Day of May, 1992

*Attest:*

DOUGLAS B. COMER

*Attesting Officer*

*Acting Commissioner of Patents and Trademarks*